United States Patent [19]

Englehardt

[11] Patent Number: 4,460,847

[45] Date of Patent: Jul. 17, 1984

[54] SPARK PLUG

[75] Inventor: Clyde R. Englehardt, Sylvania, Ohio

[73] Assignee: Champion Spark Plug Company, Toledo, Ohio

[21] Appl. No.: 287,261

[22] Filed: Jul. 27, 1981

[51] Int. Cl.[3] ..... H01T 1/16; H01T 13/40

[52] U.S. Cl. ..... 315/58; 313/136

[58] Field of Search ..... 315/58, 59, 71; 313/118, 136

[56] References Cited

U.S. PATENT DOCUMENTS

| | | | |
|---|---|---|---|
| 1,960,316 | 5/1934 | Rabezzana | 315/58 |
| 2,020,966 | 11/1935 | Rohde | 123/169 |
| 2,020,967 | 11/1935 | Rohde | 29/84 |
| 2,336,570 | 12/1943 | Rabezzana | 123/173 |
| 2,367,445 | 1/1945 | Stoltenberg | 123/169 |
| 2,371,211 | 3/1945 | Barrington | 123/169 |
| 2,380,579 | 7/1945 | Cipriani | 123/169 |
| 2,453,048 | 11/1948 | Tognola et al. | 315/58 |
| 2,576,176 | 11/1951 | Faatz | 123/169 |
| 2,798,980 | 7/1957 | Beardslee, Jr. | 313/136 |
| 2,837,679 | 6/1958 | Schwartzwalder et al. | 313/145 |
| 2,898,395 | 8/1959 | Schurecht | 174/152 |
| 3,173,056 | 3/1965 | Dressel | 315/58 |
| 3,370,331 | 2/1968 | Beardslee, Jr. | 29/25.12 |
| 3,903,453 | 9/1975 | Nishio | 315/58 |

*Primary Examiner*—Eugene R. LaRoche
*Attorney, Agent, or Firm*—John C. Purdue

[57] ABSTRACT

A spark plug having an internal resistor and resistor-bore seal is disclosed. The spark plug comprises a shell, an insulator assembly carried by the shell and a ground electrode structurally integral with the shell. The insulator assembly comprises an insulator having a firing end and a terminal end, and a bore extending therethrough, and a center electrode within the bore of the insulator, and having a firing end firing in spark gap relationship with the ground electrode. The assembly also comprises a resistor positioned within the bore of the insulator and in electrical contact with the center electrode. The longitudinal position of the resistor in the bore of the insulator is radially inward of the shell. The assembly also includes an electrically nonconductive and substantially gas-impervious seal compacted between the walls of the bore of the insulator and longitudinally extending walls of the resistor. The electrically non-conductive material can be covered by an electrically conductive cup.

A method for producing the foregoing spark plug is also disclosed.

8 Claims, 9 Drawing Figures

SPARK PLUG

BACKGROUND OF THE INVENTION

1. Field of the Invention

This invention relates to resistor spark plugs and to methods for producing resistor spark plugs.

2. Description of the Prior Art

A resistor spark plug comprises a shell, an insulator assembly carried by the shell, and a ground electrode structurally integral with the shell. The insulator assembly comprises an insulator having a firing end and a terminal end and a bore, usually stepped, extending therethrough, a center electrode seated in the bore, and having a firing end and an opposed end within the bore, a resistor having walls extending longitudinally within the bore and one end in electrical contact with the bore end of the center electrode and the other end in electrical contact with a terminal, usually through a spring. The ground electrode and the center electrode are positioned in spark gap relationship, within a combustion chamber of an internal combustion engine, when the spark plug is in service.

SUMMARY OF THE INVENTION

The environment within the bore of a spark plug insulator can cause deterioration of a resistor to such an extent that its electrical characteristics are altered, thus causing poor spark plug performance or failure. The present invention is based upon the discovery that this problem can be corrected by sealing the resistor in a body of talc or of another electrically nonconductive material to isolate it from the hostile environment, and that the talc or other electrically nonconductive material can also prevent the escape of gases from the combustion chamber. In addition to being sealed within the body of talc or the like, the resistor can also be embedded in the center electrode of the spark plug.

Preferably, the resistor and the seal are near the firing end of the insulator of the spark plug to minimize electromagnetic interference (EMI) and capacitive refirings. The multi-purpose bore seal is an electrically nonconductive material which is compacted, or compacted and fired, to form it into a substantially gas-impervious body which is in contact with an end of the center electrode and positioned in the annular space between the longitudinally extending walls of the bore and the walls of the resistor. As a result, the center electrode and the resistor are held firmly in place within the insulator bore by a gas-tight seal between the bore and the center electrode and around the resistor.

The instant invention is also based on the discovery of a method for securing a resistor and a center electrode in a bore of a ceramic insulator. The method involves the steps of preforming into a cylindrical tube an electrically nonconductive material which is compactable into a substantially gas-impervious condition, and compacting the preformed cylindrical tube against an end of the center electrode between the longitudinally extending walls of the bore and the walls of the resistor.

OBJECTS OF THE INVENTION

It is an object of the invention to provide a resistor spark plug having one multi-purpose bore seal.

It is another object of the invention to provide a resistor spark plug with the resistor positioned radially inwardly from the shell of the spark plug to minimize EMI and capacitive refirings.

It is a further object to provide a method for securing a resistor and a center electrode in the stepped bore of a ceramic insulator.

DETAILED DESCRIPTION OF THE INVENTION

Figure 1:
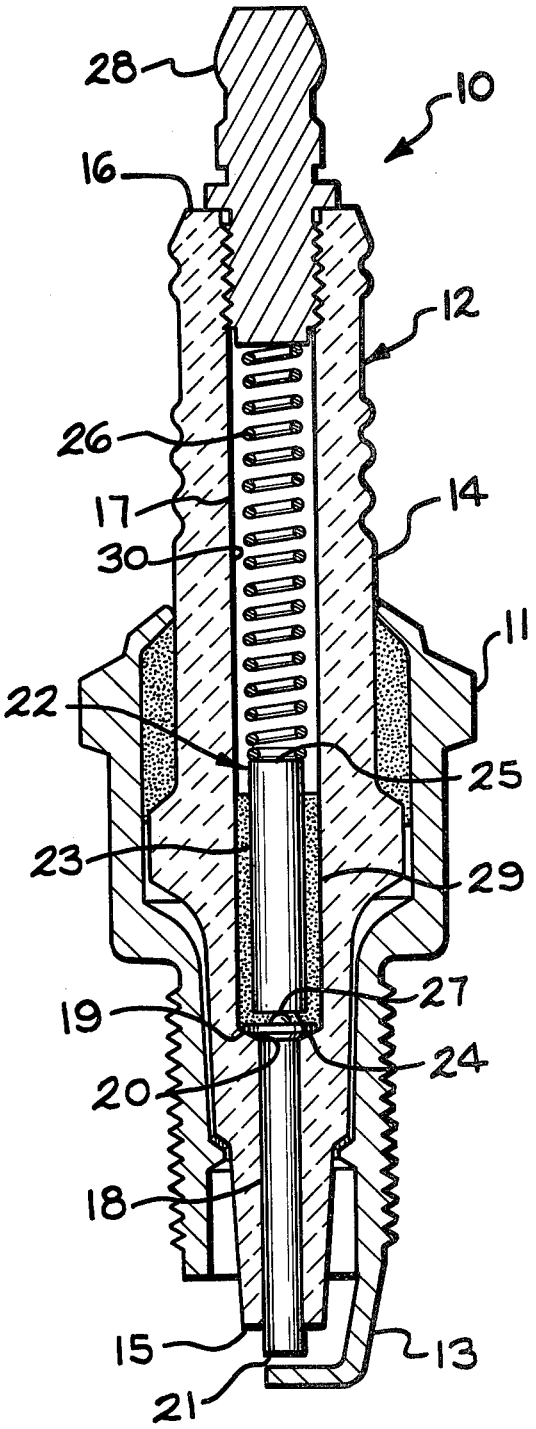
FIG. 1 is a partially schematic, vertical sectional view showing a resistor spark plug in accordance with the invention. The spark plug has a single ground electrode, a resistor having one end in electrical contact with the headed end of a center electrode, and an electrically nonconductive and substantially gas-impervious material surrounding the resistor.

Referring now in more detail to the drawings, and, in particular to FIG. 1, a spark plug according to the invention is indicated generally at 10. The spark plug 10 comprises a threaded shell 11, an insulator assembly 12 carried by the shell 11 and a ground electrode 13 structurally integral with the shell 11. The insulator assembly 12 comprises an insulator 14 having a firing end 15 and a terminal end 16 and a stepped bore 17 extending therethrough. A center electrode 18 having a headed end 19 is seated on a shoulder 20 of the stepped bore 17. The electrode 18 has, at the firing end 15 of the insulator 14, a firing end 21 in spark gap relationship with the ground electrode 13. In service, the ground electrode 13 and the firing end 21 of the center electrode 18 are positioned within a combustion chamber of an internal combustion engine (not shown). The insulator assembly 12 also comprises a resistor 22 having walls 23 extending longitudinally within the bore 17, and ends 24 and 25.

The end 24 of the resistor 22 is in electrical contact with the headed end 19 of the center electrode 18, while the end 25 is in contact with a spring 26 which yieldingly urges the resistor 22 toward the headed end 19 of the center electrode 18. The end 24 of the resistor 23 seats against a nib 27 on the headed end 19 of the center electrode 18 and is held in electrical contact therewith by the spring 26 which, in turn, is in electrical contact with an electrically conducting terminal 28. Thus, there is a complete electrical path from the terminal 28 to the center electrode 18.

The insulator assembly 12 also comprises a body 29 of an electrically nonconductive and substantially gas-impervious material filling the space between longitudinally extending walls 30 of the bore 17 and a portion of the walls 23 of the resistor 22 adjacent the headed end 19 of the center electrode 18. A portion of the walls 23 of the resistor 22 adjacent the end 25 thereof extends beyond the body 29, which can be composed of compacted powdered talc or alumina or a combination of these materials with an inorganic binder. The body 29 can also be made by firing compacted powdered glass. In either case, the body 29 forms (1) a resistor seal to prevent deterioration of the resistor 22 and the subsequent alteration of its electrical characteristics, (2) a bore seal to contain gases within the combustion chamber of an associated engine, (3) a bore cushion to compensate for differences in thermal expansion between the insulator 14 and the center electrode 18, and (4) a restraining device to hold the headed end 19 of the center electrode 18 firmly in place against the shoulder 20 of the stepped bore 17.

Figure 5:
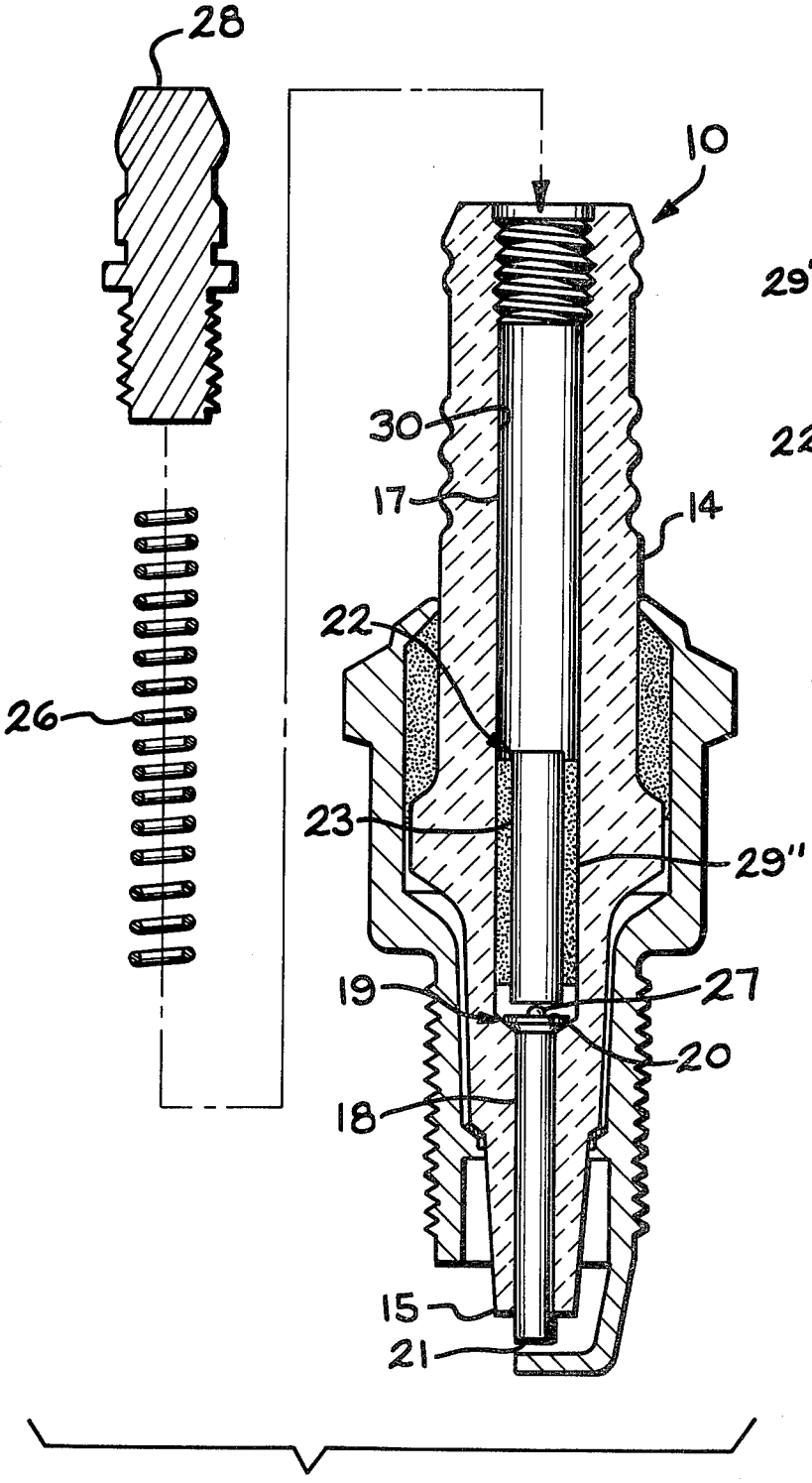
FIG. 5 is an exploded view, with parts in section, showing the spark plug of FIG. 1 before the electrically nonconductive material is compacted around the resistor and against the headed end of the center electrode, and illustrating additional steps involved in assembly.

The body 29 can be produced from a preformed cylindrical tube 29'' (FIG. 6), which, after assembly with a resistor 22, as shown, is inserted into the bore 17 (as shown in FIG. 5) and is then compacted to form the body 29 (FIG. 1) of the electrically nonconductive and substantially gas-impervious material between the longitudinally extending walls 30 of the bore 17 and the walls 23 of the resistor 22. The resistor 22 can be made structurally and electrically integral with the headed end 19 of the center electrode 18, as shown in FIG. 2.

Figure 2:
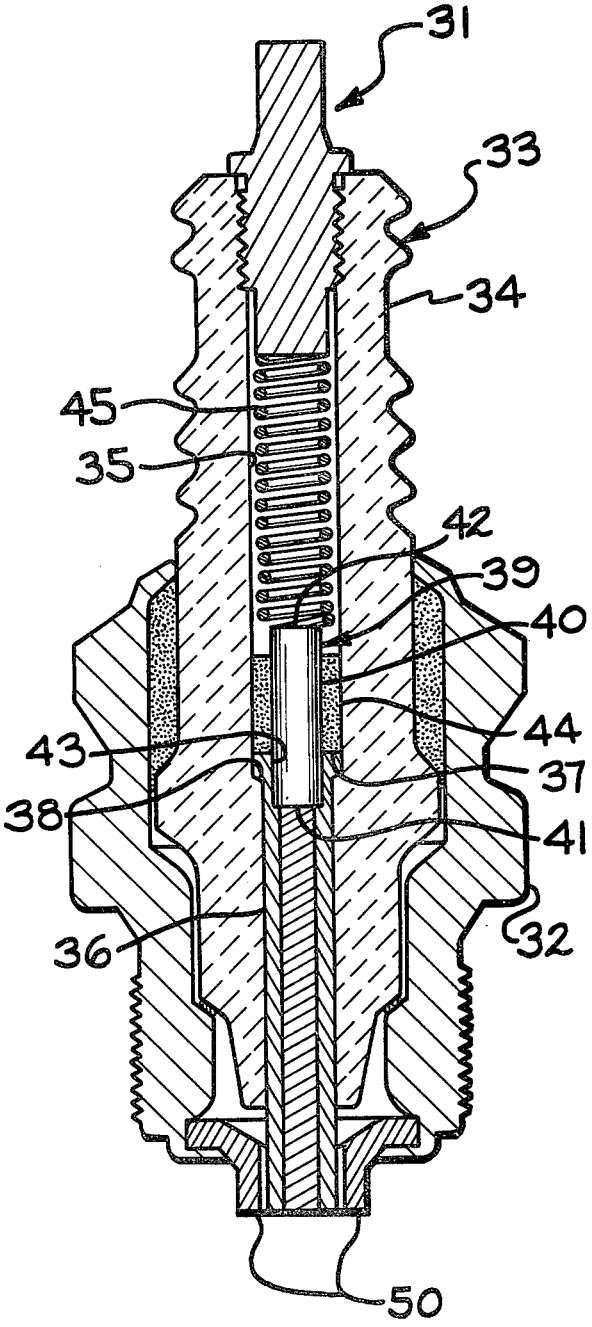
FIG. 2 is a partially schematic, vertical sectional view showing another resistor spark plug in accordance with the invention. The spark plug of FIG. 2 has a ground electrode with multiple contacts, a resistor having one end embedded in a recess in the headed end of a center electrode, and an electrically nonconductive and substantially gas-impervious material surrounding the resistor.

A spark plug indicated generally at 31 in FIG. 2 comprises a threaded shell 32 and an insulator assembly 33 carried by the shell 32. The insulator assembly 33 comprises an insulator 34 having a stepped bore 35 extending therethrough. A center electrode 36 having a headed end 37 is seated on a shoulder 38 of the stepped bore 35. A resistor 39 has walls 40 which extend longitudinally within the bore 35, and opposed ends 41 and 42. The end 41 of the resistor 39 is structurally integral with the headed end of 37 of the center electrode 36, being engaged within a bore 43 therein. The insulator assembly also includes a body 44 of an electrically nonconductive and substantially gas-impervious material. The body 44 contacts the headed end 37 of the center electrode 36, and extends therefrom between the walls of the bore 35 and the walls 40 of the resistor 39, terminating short of the end 42 of the resistor 39. The end 42 of the resistor 39 is in contact with a spring 45.

Figure 3:
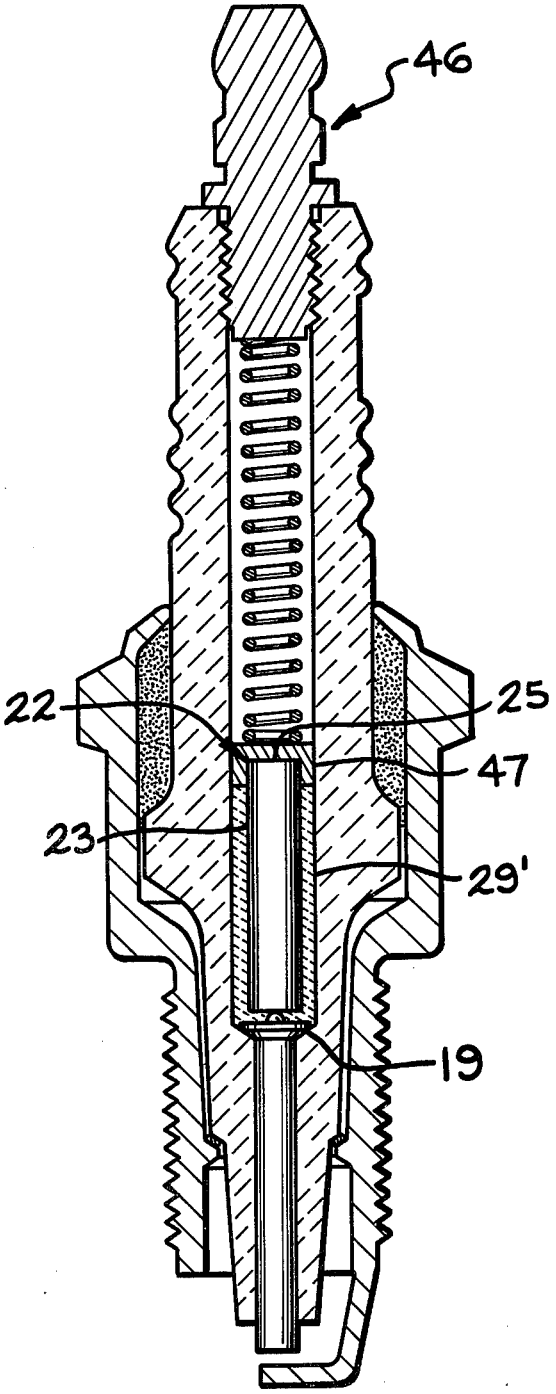
FIG. 3 is a sectional view showing a modification of the spark plug of FIG. 1 where an electrically conductive confining member covers an end of the resistor.

A spark plug indicated generally at 46 in FIG. 3 is similar to the spark plug 10 of FIG. 1 except where indicated by additional reference numerals. Referring to FIG. 3, a body 29' of electrically nonconductive material is glass, produced by packing powdered glass around the walls 23 adjacent the head 19 of the electrode 18 and then packing a powdered electrically conductive material over the glass and around the upper part of the walls 23 and over the end 25 of the resistor 22, and firing the resulting assembly. The firing forms the powdered glass into the body 29'', and forms the powdered conductive material into a cup 47.

Figure 4:
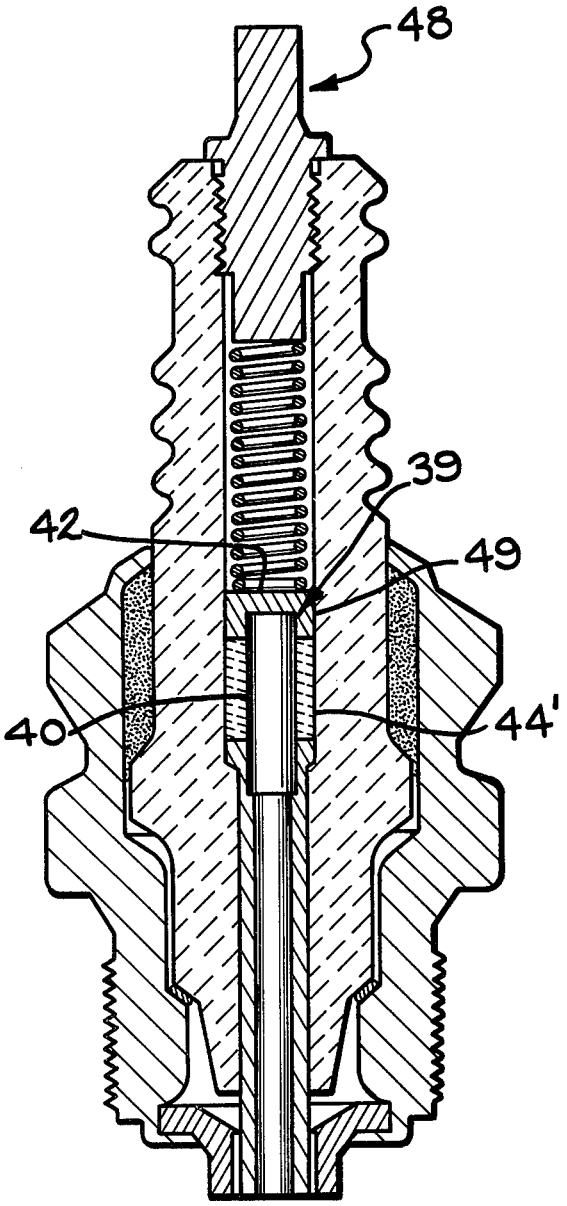
FIG. 4 is a sectional view showing a modification of the spark plug of FIG. 2 where an electrically conductive confining member covers an end of the resistor.

A spark plug indicated generally at 48 in FIG. 4 is similar to the spark plug 31 of FIG. 2 except where indicated by additional reference numerals. Referring to FIG. 4, a body 44' of electrically nonconductive material is produced by packing powdered glass around the walls 40 adjacent the head 37 of the electrode 36 and then packing a powdered electrically conductive material over the glass and around the upper part of the walls 40 and over the end 42 of the resistor 39, and firing the resulting assembly. The firing forms the powdered glass into the body 44' and forms the powdered conductive material into a cup 49. The electrically conductive material from which the cup 49 is formed can be powdered brass, as can the material from which the cup 47 of FIG. 3 is formed.

The operation of most conventional spark plugs causes electromagnetic interference with other electronic equipment, such as television, as well as on-board electronic equipment. It has been found that, when the position of the resistor 22 (FIG. 1) in the base of the insulator 14 is radially inward of the shell 11, the spark plug 10 in service not only shows reduced EMI, but also has increased life, by comparison with an otherwise identical plug where the resistor is not radially inward of the shell. The resistor, when radially inward of the shell, is believed to be more effective at suppressing capacitive refirings which contribute to electrode erosion. An additional feature is that the insulator 14 itself can be shortened. The same observations have been made when the resistor 22 is properly positioned within the spark plug 31 (FIG. 3), and similarly, when the resistor 39 is properly positioned within the spark plugs 31 and 48 (FIGS. 2 and 4, respectively).

Figure 6:
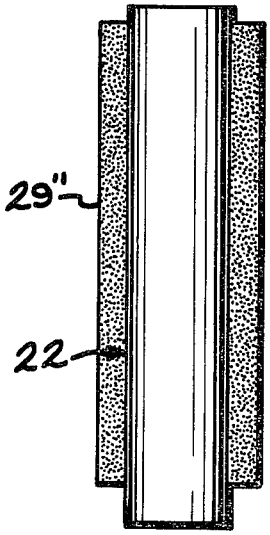
FIG. 6 is an enlarged sectional view showing the resistor and a preformed cylindrical tube of the electrically nonconductive material of FIG. 5.

The spark plug 10 of FIG. 1 is shown in FIG. 5 at an intermediate point of assembly. As shown, the headed end 19 of the center electrode 18 is seated on the shoulder 20 of the stepped bore 17 of the insulator 14, with the firing end 21 of the center electrode 18 extending through the firing end 15 of the insulator 14. The resistor 22, surrounded by a preform 29'' of an electrically nonconductive material, rests on the nib 27 on the headed end 19 of the center electrode 18. To complete the assembly of the spark plug 10, the preformed cylindrical tube 29'' is compacted to form the electrically nonconductive and substantially gas-impervious seal 29, and the spring 26 is inserted, followed by the terminal 28, as illustrated in FIG. 1. The resistor 22, surrounded by the preform 29'', is shown in FIG. 6.

Figure 7:
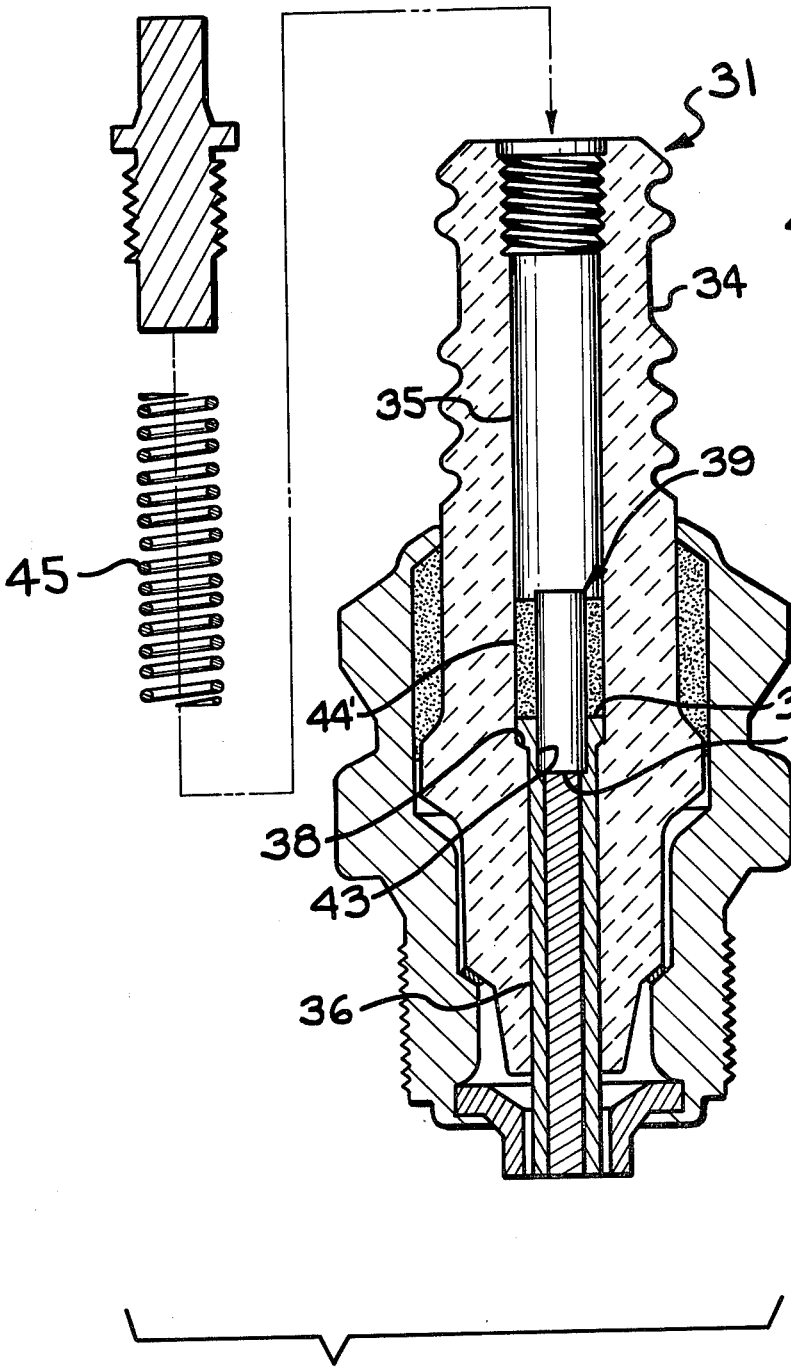
FIG. 7 is an exploded view, with parts in section, showing the spark plug of FIG. 2 before the electrically nonconductive material is compacted around the resistor and against the headed end of the center electrode, and illustrating additional steps involved in assembly.
Figure 8:
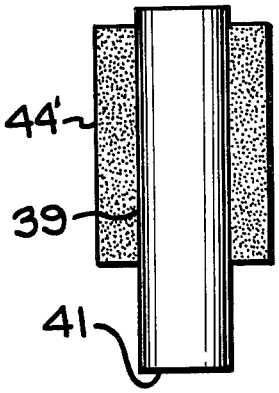
FIG. 8 is an enlarged sectional view showing the resistor and a preformed cylindrical tube of the electrically nonconductive material of FIG. 7.

The spark plug 31 of FIG. 2 is shown in FIG. 7 at an intermediate point of assembly. As shown, the headed end 37 of the center electrode 36 is seated on the shoulder 38 of the stepped bore 35 of the insulator 34. The resistor 39, surrounded by a preform 44' of an electrically nonconductive material, is positioned within the bore 35 of the insulator 34 so that the end 41 thereof fits within the bore 43 of the headed end 37 of the center electrode 36. To complete the assembly of the spark plug 31, the preformed cylindrical tube 44' is compacted to form the electrically nonconductive and substantially gas-impervious seal 44, and the spring 45 is inserted, followed by the terminal, as illustrated in FIG. 2. The resistor 39, surrounded by the preform 44', is shown in FIG. 8.

Figure 9:
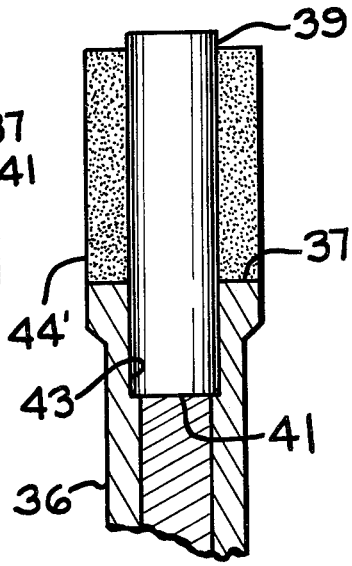
FIG. 9 is an enlarged sectional view showing the resistor, the preformed cylindrical tube and a portion of the headed center electrode of FIG. 7.

The resistor 39 and the headed end 37 of the center electrode 36 can be secured in the stepped bore 35 of the insulator 34 as shown in FIG. 7 by another series of steps. Referring to FIG. 9, the end 41 of the resistor 39 is seated within the bore 43 of the headed end 37 of the center electrode 36. The preformed cylindrical tube 44' is then positioned over the resistor 39 against the headed end 37 of the center electrode 36 to form a center electrode assembly. This assembly is then positioned within the stepped bore 35 so that the headed end 37 of the center electrode 36 is seated on the shoulder 38 thereof as illustrated in FIG. 7. Finally, the preformed cylindrical tube 44' is compacted to form the electrically nonconductive and substantially gas-impervious material 44, and the spring 45 is inserted, followed by the terminal, as illustrated in FIG. 2.

In any one of the methods described above, the body of electrically nonconductive material can be a mixture of an inorganic binder with powdered talc or alumina or a combination of talc and alumina, or can be glass. When the body is glass, powdered glass is first packed around the resistor, while positioned within the spark plug bore, and a powder of an electrically conductive material is then packed over the glass. The resulting assembly is then fired to complete the seal as illustrated in FIGS. 3 and 4. In either case, the electrically conductive material can be powdered brass.

It will be apparent that various changes may be made in details of construction from those shown in the attached drawings and discussed in conjunction therewith without departing from the spirit and scope of this invention as defined in the appended claims. For example, it will be appreciated that the configuration of the ground electrode can be one of any type: the single electrode 13 of FIG. 1, multiple electrodes 50 of FIG. 2, an annular electrode, or the like. It is, therefore, to be understood that this invention is not to be limited to the specific details shown and described.

What I claim is:

1. A spark plug comprising a shell releasably engageable with an internal combustion engine, an insulator assembly carried by said shell and a ground electrode structurally integral with said shell, said assembly comprising an insulator having a firing end and a terminal end, and a bore extending therethrough, a center electrode within the bore of said insulator, and having a firing end in spark gap relationship with said ground electrode and an opposed end, an electrically conducting terminal seated in the terminal end of said insulator, a resistor having opposed ends and a resilient, electrically conductive member seated within the bore of said insulator and positioned between the opposed end of said center electrode and said terminal, one of the opposed ends of said resistor being in electrical contact with one of said terminal and the opposed end of said center electrode, and said resilient member being compressed between and exerting a force against the other of the opposed ends of said resistor and the other of said terminal and the opposed end of said center electrode, and an electrically nonconductive and substantially gas-impervious seal compacted between the walls of the bore of said insulator and longitudinally extending walls of said resistor, said seal being positioned so that it is not in contact with said resilient member.

2. A spark plug as claimed in claim 1 wherein the longitudinal position of said resistor in the bore of said insulator is radially inward of said shell.

3. A spark plug as claimed in claim 1 wherein said resistor is in electrical contact with the opposed end of said center electrode.

4. A spark plug as claimed in claim 3 wherein said resistor is structurally integral with the opposed end of said center electrode.

5. A spark plug as claimed in claim 3 or 4 wherein said electrically nonconductive material is an inorganic binder and powdered talc or alumina or a combination of talc and alumina.

6. A spark plug as claimed in claim 3 or 4 wherein said electrically nonconductive material is vitrified powdered glass.

7. A spark plug as claimed in claim 6 wherein said electrically nonconductive material surrounds only a portion of said resistor and is covered by an electrically conductive material compacted around the remaining portion of said resistor and over the end of said resistor which is in electrical contact with said electrically conductive member.

8. A spark plug as claimed in claim 7 wherein the electrically conductive material is powdered brass.

* * * * *